US006072446A

United States Patent [19]

Tokimoto

[11] Patent Number: 6,072,446

[45] Date of Patent: Jun. 6, 2000

[54] SCROLL DISPLAY METHOD AND APPARATUS

[75] Inventor: Toyotaro Tokimoto, Yokohama, Japan

[73] Assignee: Avix Inc., Kanagawa, Japan

[21] Appl. No.: 08/981,673

[22] PCT Filed: May 16, 1997

[86] PCT No.: PCT/JP97/01655

§ 371 Date: Jan. 6, 1998

§ 102(e) Date: Jan. 6, 1998

[87] PCT Pub. No.: WO97/44773

PCT Pub. Date: Nov. 27, 1997

[30] Foreign Application Priority Data

May 22, 1996 [JP] Japan ..... 8-126718

[51] Int. Cl.[7] ..... G09G 3/20; G09G 5/02

[52] U.S. Cl. ..... 345/56; 345/152

[58] Field of Search ..... 345/56, 123, 124, 345/467, 468, 471, 472, 152

[56] References Cited

U.S. PATENT DOCUMENTS

| | | | |
|---|---|---|---|
| 4,368,485 | 1/1983 | Midland | 345/152 |
| 4,652,912 | 3/1987 | Masubuchi | 345/152 |
| 5,302,965 | 4/1994 | Belcher et al. | 345/31 |
| 5,712,655 | 1/1998 | Noble et al. | 345/123 |
| 5,767,822 | 6/1998 | Hiroshi | 345/31 |

FOREIGN PATENT DOCUMENTS

| | | |
|---|---|---|
| 3-73995 | 3/1991 | Japan . |
| 4-12277 | 1/1992 | Japan . |
| 4-85489 | 7/1992 | Japan . |
| 4-504624 | 8/1992 | Japan . |
| 6-55184 | 7/1994 | Japan . |
| 8-179717 | 7/1996 | Japan . |
| 9-114415 | 5/1997 | Japan . |
| 9-134143 | 5/1997 | Japan . |

*Primary Examiner*—Mark R. Powell
*Assistant Examiner*—Anthony J. Blackman
*Attorney, Agent, or Firm*—Barnes & Thornburg

[57] ABSTRACT

A definite multiple color image of a large size is scrolling displayed with a small number of light emitting cells. A physical screen which includes sixteen (16) dots in one column and thirty (30) dots in one row is formed from ten (10) light emitting cell column sets Si (RCi, GCi, BCi) connected to each other like a belt. The physical screen is regarded as an imaginary screen which includes sixteen (16) dots in one column and fifty seven (57) (=30+3×9) dots in one row. When the red light emitting cell column RCi in a certain light emitting cell column set Si is controlled and driven with red data for a certain column (k) selected at intervals, the green light emitting cell column GCi is controlled and driven with green data for an adjacent column (k+1) to the selected column (k), and the blue light emitting cell column BCi is controlled and driven with blue data for a further adjacent column (k+2).

4 Claims, 7 Drawing Sheets

FIG. 6

| ADDRESS | IMAGE MEMORY | DATA DISTRIBUTION DESTINATION ① | ② | ③ | ④ | ⑤ | ⑥ | ⑦ | CYCLE → |
|---|---|---|---|---|---|---|---|---|---|
| f | RD1 | RC1 | | | | | | | |
| f+1 | GD1 | | | | | | | | |
| f+2 | BD1 | | | | | | | | |
| f+3 | RD2 | | RC1 | | | | | | |
| f+4 | GD2 | GC1 | | | | | | | |
| f+5 | BD2 | | | | | | | | |
| f+6 | RD3 | | | RC1 | | | | | |
| f+7 | GD3 | | GC1 | | | | | | |
| f+8 | BD3 | BC1 | | | | | | | |
| f+9 | RD4 | | | | RC1 | | | | |
| f+10 | GD4 | | | GC1 | | | | | |
| f+11 | BD4 | | BC1 | | | | | | |
| f+12 | RD5 | | | | | RC1 | | | |
| f+13 | GD5 | | | | GC1 | | | | |
| f+14 | BD5 | | | BC1 | | | | | |
| f+15 | RD6 | | | | | | RC1 | | |
| f+16 | GD6 | | | | | GC1 | | | |
| f+17 | BD6 | | | | BC1 | | | | |
| f+18 | RD7 | RC2 | | | | | | RC1 | |
| f+19 | GD7 | | | | | | GC1 | | |
| f+20 | BD7 | | | | | BC1 | | | |
| f+21 | RD8 | | RC2 | | | | | | |
| f+22 | GD8 | GC2 | | | | | | GC1 | |
| f+23 | BD8 | | | | | | BC1 | | |
| f+24 | RD9 | | | RC2 | | | | | |
| f+25 | GD9 | | GC2 | | | | | | |
| f+26 | BD9 | BC2 | | | | | | BC1 | |
| f+27 | RD10 | | | | RC2 | | | | |
| f+28 | GD10 | | | GC2 | | | | | |
| f+29 | BD10 | | BC2 | | | | | | |
| f+30 | RD11 | | | | | RC2 | | | |
| f+31 | GD11 | | | | GC2 | | | | |
| f+32 | BD11 | | | BC2 | | | | | |

SCROLL DISPLAY METHOD AND APPARATUS

CROSS-REFERENCE TO RELATED APPLICATIONS

This application is a U.S. national application of international application serial No. PCT/JP97/01655 filed May 16, 1997, which claims priority to Japanese Serial No. 8-126718 filed May 22, 1996.

1.Technical Field

The present invention relates to a method of and an apparatus for scrolling displaying characters or a graphic form on a light emitting cell array wherein light emitting cells such as high luminance light emitting diodes, i.e., LEDs, are arranged two-dimensionally.

2. Background Art

Display panels of the dot matrix type wherein light emitting cells such as LEDs are arranged at fixed distances in rows and columns have spread popularly and widely. On a simple LED display panel which is used for a guide display in an electric car or an advertisement display of a store, principally a character train is scrolling displayed on a display panel of a limited size. For example, character train data of the bit map type wherein one character is composed of 16×16 dots are successively produced and displayed by scrolling on a display panel of the dot matrix type wherein sixteen (16) dots are arranged in a column and a number of dots greater than at least several times as large as sixteen (16) are arranged in a row.

Also another display panel of the dot matrix type is known wherein multiple color emitting cells, each including a red LED chip and a green LED chip embedded very closely to each other in one lens body is used, or multiple color emitting cells, each including red LED lamps and green LED lamps arranged in a mixed condition so as to form one aggregate lamp is used to display an image of multiple colors. Also a further display panel is known which additionally includes blue LEDs to allow display of full colors.

For example, where a character train is displayed by feeding, i.e., displayed by scrolling in a horizontal direction on such a horizontally elongated display panel of the dot matrix type as described above, in order to increase the number of characters which can be displayed at a time, naturally the number of dots in the horizontal direction of the display panel must be increased. Accordingly, a considerable increase in cost is required for such simple expansion of a display panel.

Meanwhile, if the distances between light emitting cells arranged in rows and columns are increased to increase the size of a display panel in order to provide a display of a large size, a display image becomes very rough and the display quality is deteriorated remarkably. Therefore, the size of a display panel is increased by increasing the number of light emitting cells without increasing the distances between the light emitting cells very much. Meanwhile, the definition of display data is increased by constructing one character with 32×32 dots or the like. By such countermeasures, a display of a large size and a high quality can be obtained. However, a remarkable increase in cost must be expected for the countermeasures. Naturally, an apparatus which displays in multiple colors becomes very expensive.

Further, in a conventional display panel of the dot matrix type, irrespective of whether the size thereof is large or small, a large number of light emitting cells are mounted on a circuit board and accommodated in a flat panel type case together with a drive circuit. Naturally, the display panel is a rigid body and is not so flexible as to allow it to be folded freely, or divided into small parts or contracted or expanded, although it may be divided into several parts. While a display panel of a very small size can be carried entirely as some display panels for advertisement of a store are portable, most of display panels of the type described are installed fixedly at predetermined locations. This apparatus form is considered to be one of obstacles to expansion in application.

SUMMARY OF THE INVENTION

The present invention has been made in view of the conventional problems described above, and particularly, in order to attain the following and other objects:

(a) to provide a scrolling display method and apparatus by which a definite image of a large size can be displayed with a small number of light emitting cells; particularly to realize an image display of multiple colors with a number of light emitting cells as small as possible and rationalize the equilibrium between the definition and the color divergence of an image; and (b) to provide a scrolling display method and apparatus by which a display screen of a large size can be realized not in an apparatus form of a display panel of a rigid body having a size a little larger than a display size but in a flexible apparatus form wherein a large number of bar-shaped display elements are arranged at suitable distances.

One Aspect of the Invention

A scrolling display method of one aspect of the present invention comprises the following steps of providing a light emitting cell column of a first color wherein m light emitting cells of the first color are arranged linearly with a small distance a left therebetween, a light emitting cell column of a second color wherein m light emitting cells of the second color are arranged linearly with the small distance a left therebetween, and arranging the light emitting cell column of the first color and the light emitting cell column of the second color in parallel to each other with a distance b left therebetween which is substantially equal to the distance a to form a light emitting cell set, preparing and arranging n sets of the light emitting cell column substantially in parallel to each other in a great pitch greater than substantially three times the distance b such that, by the arrangement, a physical screen wherein the n light emitting cell columns of the first color and the n light emitting cell columns of the second color are connected to each other like a belt and each column includes m dots while each row includes 2n dots, producing bit map image data with regarding the physical screen as an imaginary screen of a pixel construction wherein one column includes m dots and one row includes w dots, so that a multiple color image may be displayed in the dot density on the imaginary screen, the image data being data of separated colors of image data of the first color and image data of the second color, w being an integer equal to or larger than (3n−1), arranging the n sets of light emitting cell column which form the physical screen in an average and substantially uniform dispersion in the imaginary screen, where the light emitting cell column of the first color and the light emitting cell column of the second color in one of the light emitting cell column sets correspond to two pixel columns adjacent each other in the imaginary screen, when it is assumed that bit map image data which includes m dots in one column and includes w dots in one row are expanded on the imaginary screen to display the same, distributing data for n columns selected at intervals from among the image data of the first color for the w columns to the n sets of light emitting cell columns of the first color so that the m light emitting cells of the first color in each of the selected n columns are controlled and driven with the data for m dots of each of the selected columns, and distributing data for n columns selected at intervals from among the image data of the second color for the w columns to the n light emitting cell columns of the second color so that the m light emitting cells of the second color in each of the selected columns are controlled and driven with the data for m dots for each of the selected columns, in the control wherein data for n columns are selected at intervals from the image data of the first and second colors for the w columns and distributed to the n light emitting cell columns of the first and second colors, respectively, setting the distance between the columns selected at intervals corresponding to the arrangement distance between the light emitting cell column sets arranged dispersedly on the imaginary screen, in one of the light emitting cell column sets, when the light emitting cell column of the first color is controlled and driven with data of the first color of a certain column selected at intervals, controlling to drive the light emitting cell column of the second color with data of the second color for a column adjacent the selected column, and repeatedly conducting a data processing wherein the light emitting cells of the individual light emitting cell column sets are controlled and driven with the image data selected at intervals while the bit map image data to be expanded on the imaginary screen are successively shifted in a direction of a row, so that a scrolling multiple color image having a density of m dots per one column and w dots per one row is visually observed due to an after-image effect of a person who watches the imaginary screen.

Another Aspect of the Invention

Another aspect of the present invention provides a richer multiple color display by a combination of light emitting cells of three colors of a first color, a second color, and a third color, and comprises the following steps of providing a light emitting cell column of a first color wherein m light emitting cells of the first color are arranged linearly with a small distance a left therebetween, a light emitting cell column of a second color wherein m light emitting cells of the second color are arranged linearly with the small distance a left therebetween, and, besides, a light emitting cell column of a third color wherein m light emitting cells of the third color are arranged linearly with the small distance a left therebetween, and arranging the light emitting cell column of the first color, the light emitting cell column of the second color, and the light emitting cell column of the third color in parallel to each other with a distance b left therebetween which is substantially equal to the distance a to form a light emitting cell set, preparing and arranging n sets of the light emitting cell column substantially in parallel to each other in a great pitch greater than substantially four times the distance b such that, by the arrangement, a physical screen wherein the n light emitting cell columns of the first color, the n light emitting cell columns of the second color, and the n light emitting cell columns of the third color are connected to each other like a belt and each column includes m dots while each row includes 3n dots, producing bit map image data with regarding the physical screen as an imaginary screen of a pixel construction wherein one column includes m dots and one row includes w dots, so that a multiple color image may be displayed in the dot density on the imaginary screen, the image data being data of separated colors of image data of the first color, image data of the second color and image data of the third color, w being an integer equal to or larger than (4n−1), arranging the n light emitting cell column sets which form the physical screen in an average and substantially uniform dispersion in the imaginary screen, so that the light emitting cell column of the first color, the light emitting cell column of the second color, and the light emitting cell column of the third color in one of the light emitting cell column sets correspond to three pixel columns adjacent each other in the imaginary screen, when it is assumed that bit map image data which includes m dots in one column and includes w dots in one row are expanded on the imaginary screen to display the same, distributing data for n columns selected at intervals from among the image data of the first color for the w columns to the n light emitting cell columns of the first color so that the m light emitting cells of the first color in each of the selected n columns are controlled and driven with the data for m dots of each of the selected columns, distributing data for n columns selected at intervals from among the image data of the second color for the w columns to the n light emitting cell columns of the second color so that the m light emitting cells of the second color in each of the selected columns are controlled and driven with the data for m dots for each of the selected columns, and distributing data for n columns selected at intervals from among the image data of the third color for the w columns to the n light emitting cell columns of the third color so that the m light emitting cells of the third color in each of the selected columns are controlled and driven with the data for m dots for each of the selected columns, in the control wherein data for n columns are selected at intervals from the image data of the first, second, and third colors for the w columns and distributed to the n light emitting cell columns of the first, second, and third colors, respectively, setting the distance between the columns selected at intervals corresponding to the arrangement distance between the light emitting cell column sets arranged dispersedly on the imaginary screen, in one of the light emitting cell column sets, when the light emitting cell column of the first color is controlled and driven with data of the first color of a certain column selected at intervals, controlling to drive the light emitting cell column of the second color with data of the second color for a column adjacent the selected column, and controlling to drive the light emitting cell column of the third color with data of the third color for a column further adjacent the selected column, and repeatedly conducting a data processing wherein the light emitting cells of the individual light emitting cell column sets are controlled and driven with the image data selected at intervals while the bit map image data to be expanded on the imaginary screen are successively shifted in a direction of a row, so that a scrolling multiple color image having a density of m dots per one column and w dots per one row is visually observed due to an after-image effect of a person who watches the imaginary screen.

Yet Another Aspect of the Invention

A basic construction of a scrolling display apparatus according to the above aspects of the present invention comprises the n sets of light emitting cell columns, a memory in which bit map image data to be displayed are stored, data processing means for reading out the data from the memory in accordance with an algorithm for selection at intervals and distributing the data to the light emitting cell columns, and driving means for latching the data distributed to the light emitting cell columns by the data processing means to drive the light emitting cells of the columns.

BRIEF DESCRIPTION OF DRAWINGS

FIG. 6 is a conceptual diagram illustrating a manner of storage of image data and a construction of data distribution in the apparatus of the embodiment.

DESCRIPTION OF THE PREFERRED EMBODIMENTS

Form and Principle of Scrolling Display

Figure 1:
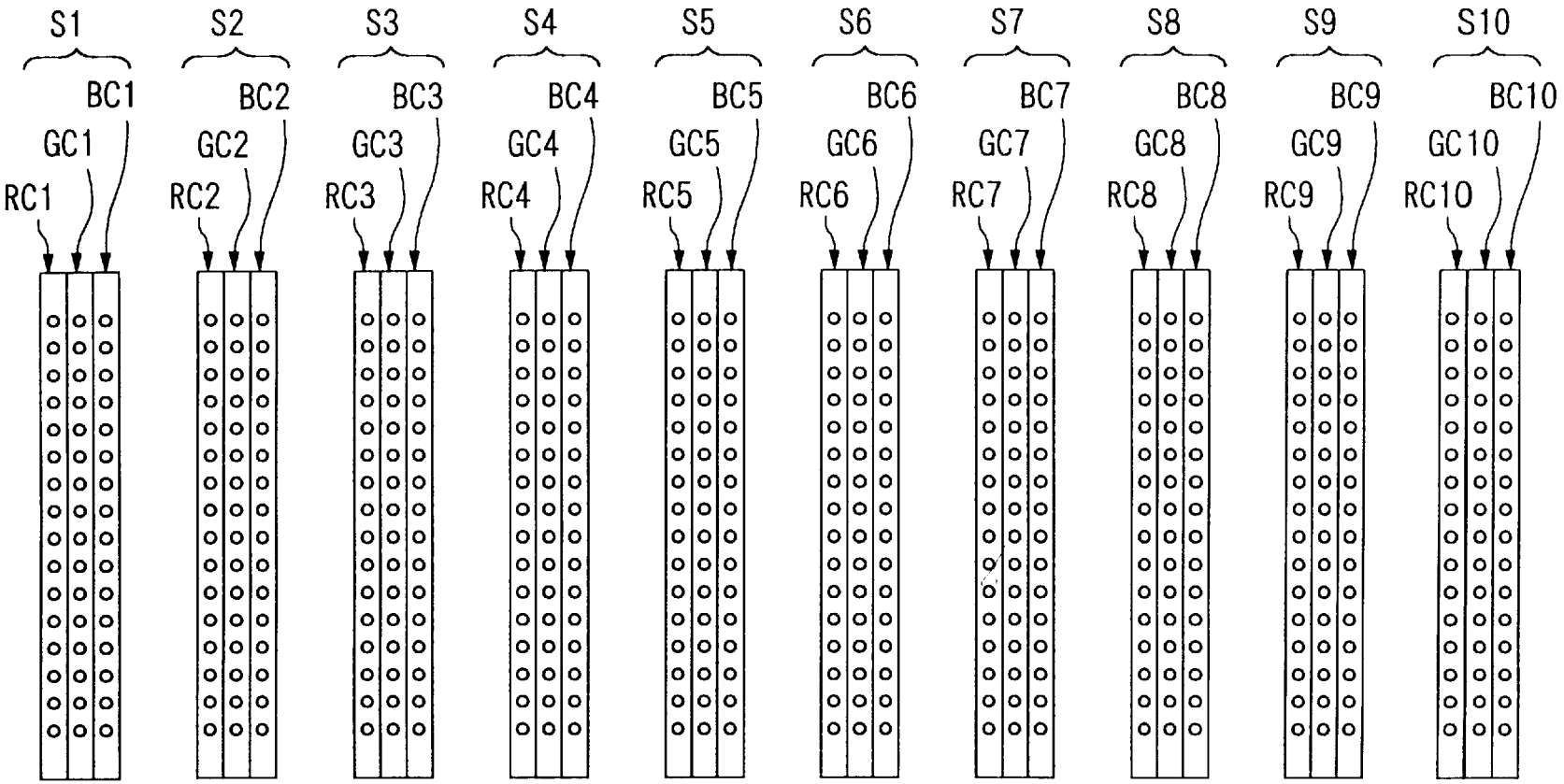
FIG. 1 is a schematic view of a physical screen realized by an arrangement of bar-shaped display elements according to an embodiment of the present invention.

An embodiment of the second aspect of the present invention wherein LEDs of three colors of red, green and blue are used, is described in detail. As shown in FIG. 1, ten (10) red light emitting cell columns RCi, each formed from sixteen (16) red LED lamps R arranged linearly at a short distance a, ten (10) green light emitting cell columns GCi, each formed from sixteen (16) green LED lamps G arranged linearly at the short distance a, and ten (10) blue light emitting cell columns BCi, each formed from sixteen (16) blue LED lamps B arranged linearly at the short distance a, are provided (i=1, 2, 3, . . . , 10).

A light emitting cell set Si is formed from one red light emitting cell column RCi, one green light emitting cell column GCi, and one blue light emitting cell column BCi arranged in parallel to each other at a small distance b substantially equal to the distance a mentioned above. In short, ten (10) light emitting cell column sets S1 to S10 are provided and arranged in parallel to each other at intervals, each of which substantially six times as large as the distance b.

In this manner, the ten (10) red light emitting cell columns RCi, the ten (10) green light emitting cell columns GCi, and the ten (10) blue light emitting cell columns BCi are connected to each other like a belt in the order of (RC1, GC1, BC1), (RC2, GC2, BC2), (RC3, GC3, BC3), . . . , (RC10, GC10, BC10), with large blank sections inserted therebetween. The belt-like arrangement of pixels which includes sixteen (16) dots in one column and thirty (30) dots in one row in this manner, is hereinafter referred to as a physical screen.

Figure 2:
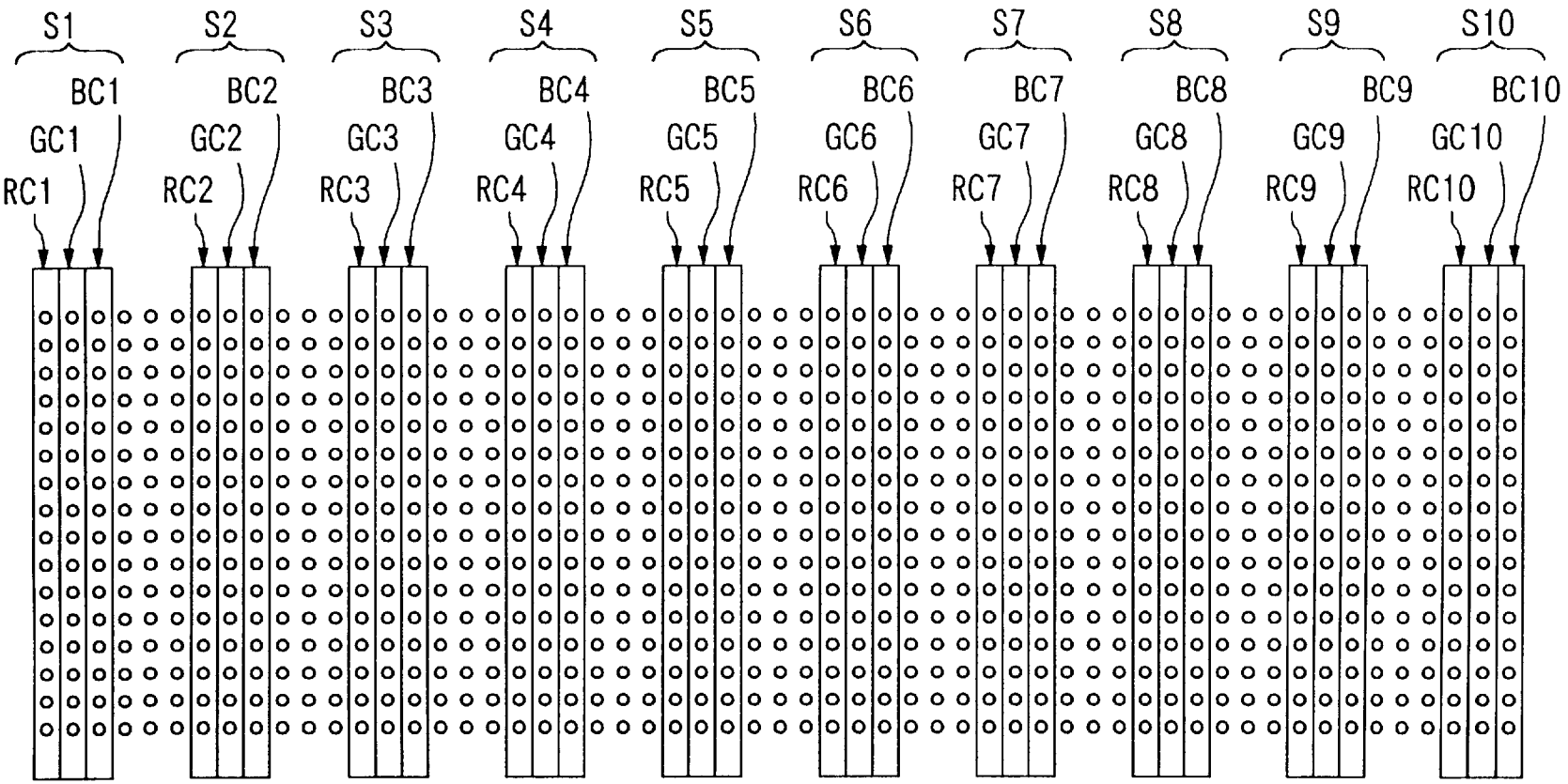
FIG. 2 is a schematic view of an imaginary screen formed corresponding to the physical screen.

Such an imaginary screen as shown in FIG. 2 is assumed from the physical screen of FIG. 1. In the physical screen of this embodiment, it is considered that three pixel columns, each including sixteen (16) dots are present in a large blank section between a light emitting cell column set Si (RCi, GCi, BCi) and an adjacent light emitting cell column set Sj (RCj, GCj, BCj). In short, the physical screen which includes sixteen (16) dots in one column and thirty (30) dots in one row is regarded as an imaginary screen which includes sixteen (16) dots in one column and fifty seven (57) (=30+3×9) dots in one row.

Further, as shown in FIG. 2, the ten (10) light emitting cell column sets Si which form the physical screen are distributed in a uniform dispersion in the imaginary screen and the red light emitting cell column RCi, the green light emitting cell column GCi, and the blue light emitting cell column BCi in one light emitting cell column set Si correspond to three adjacent pixel columns in the imaginary screen.

Image data to be displayed are produced on the assumption that, on the imaginary screen which includes sixteen (16) dots in one column and fifty seven (57) dots in one row, a multiple color image of the dot density on the imaginary screen is displayed. The image data includes data of separated colors of red data, green data, and blue data.

Figure 3:
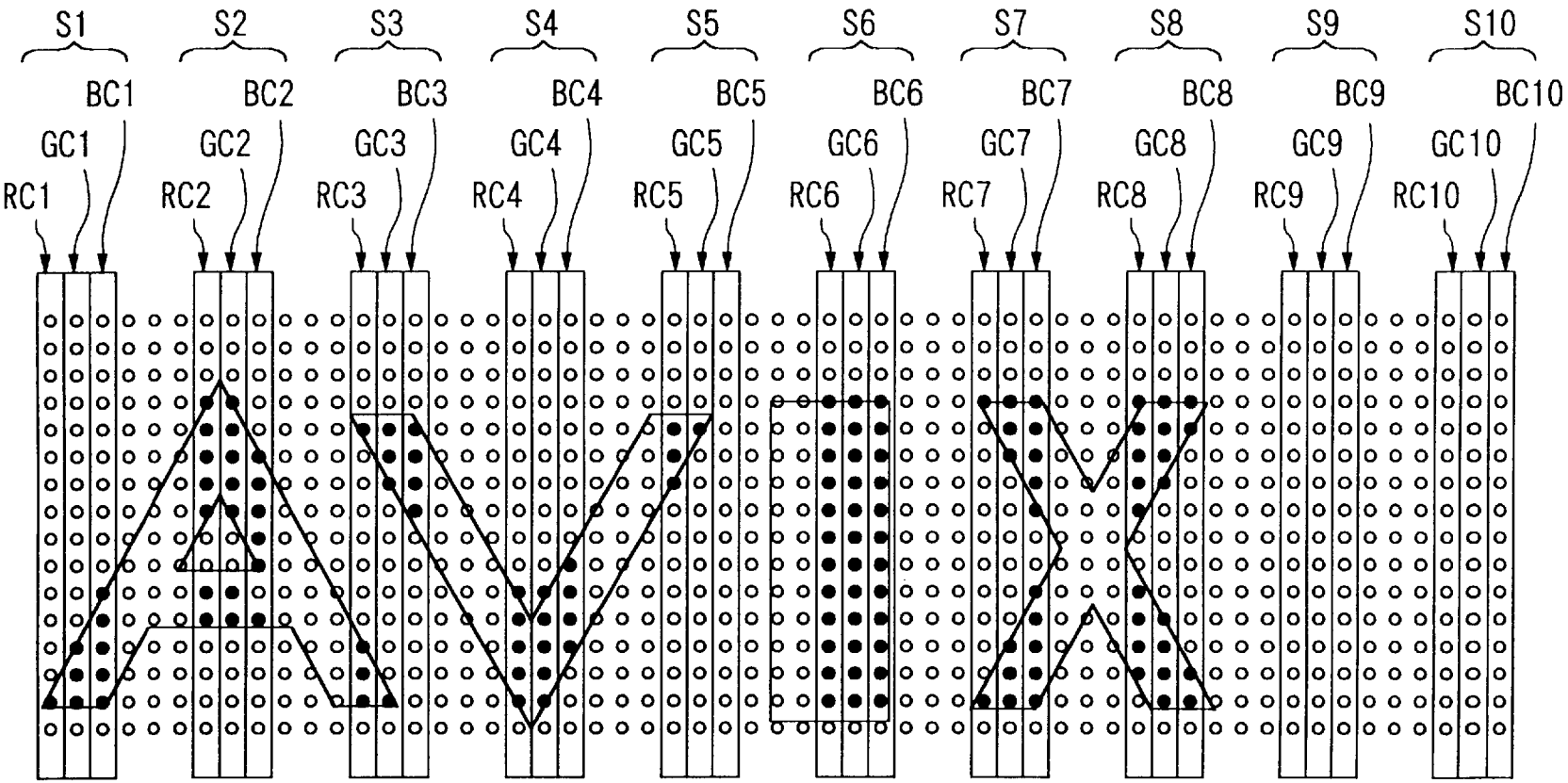
FIG. 3 is a schematic view illustrating a relationship among the physical screen, the imaginary screen, and image data to be scrolling displayed.
Figure 4:
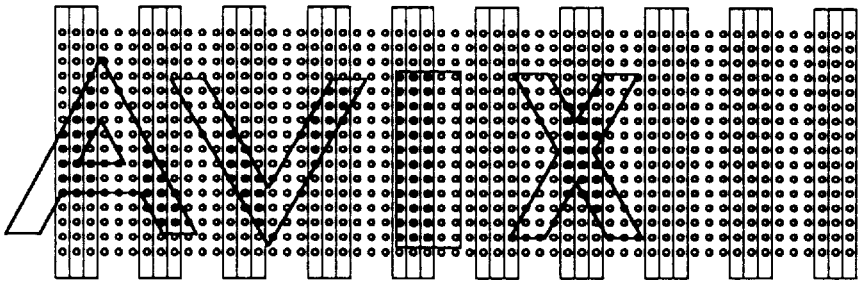
FIG. 4 is a schematic view illustrating a manner in which an image is scrolled in FIG. 3.
Figure 4:
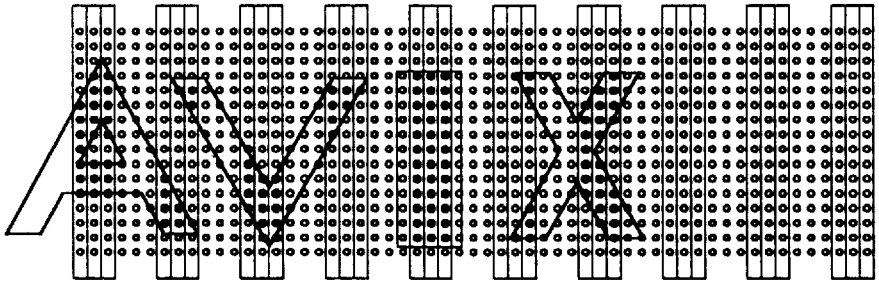
Figure 4:
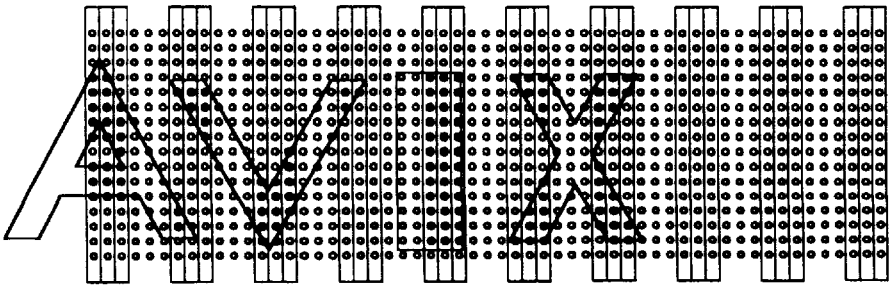

If it is assumed that bit map image data of a construction wherein one column includes sixteen (16) dots and one row includes fifty seven (57) dots, illustratively an image of a character train of "AVIX" in this embodiment, are expanded on the imaginary screen to display the data as seen in FIG. 3, actually the image data are distributed in the following manner to drive the light emitting cell array.

(a) Red data for ten (10) columns selected at intervals from among the red data for fifty seven (57) columns are distributed to the ten (10) red light emitting cell columns RC1 to RC10 so that the sixteen (16) red LED lamps in each of the columns are controlled and driven in accordance with the red data for sixteen (16) dots for each column.

(b) Simultaneously, data for ten (10) columns selected at intervals from among the green data for fifty seven (57) columns are distributed to the ten (10) green light emitting cell columns GC1 to GC10, so that the sixteen (16) green LED lamps in each of the columns are controlled and driven in accordance with the green data for sixteen (16) dots for each column.

(c) Simultaneously, blue data for ten (10) columns selected at intervals from among the blue data for fifty seven (57) columns are distributed to the ten (10) blue light emitting cell columns BC1 to BC10, so that the sixteen (16) blue LED lamps in each of the columns are controlled and driven in accordance with the blue data for sixteen (16) dots for each column.

(d) In the control wherein data of the different colors for ten (10) columns selected at intervals from among the image data including red data, green data, and blue data for fifty seven (57) columns are distributed to the ten (10) red light emitting cell columns RC1 to RC10, ten (10) green light emitting cell columns GC1 to GC10, and blue light emitting cell columns BC1 to BC10, the intervals of columns selected at intervals correspond to the arrangement distance between the light emitting cell column sets S1 to S10 arranged dispersedly on the imaginary screen.

(e) When the red light emitting cell column RCi in a certain light emitting cell column set Si is controlled and driven with red data for a column (k) selected at intervals, the green light emitting cell column GCi is controlled and driven with green data for an adjacent column (k+1) to the selected column (k) and the blue light emitting cell column BCi is controlled and driven with blue data for a further adjacent column (k+2).

(f) While the bit map image data to be expanded on the imaginary screen are shifted in the direction of a row, the data processing for controlling and driving the LED lamps of the light emitting cell column sets S1 to S10 in accordance with the image data selected at intervals is repeated so that a scrolling multiple color image of a density of sixteen (16) dots in one column and fifty seven (57) dots in one row is visually observed due to an after-image effect of a person watching the imaginary screen.

Circuit Construction of Scrolling Display Apparatus and Data Flow in it

Figure 5:
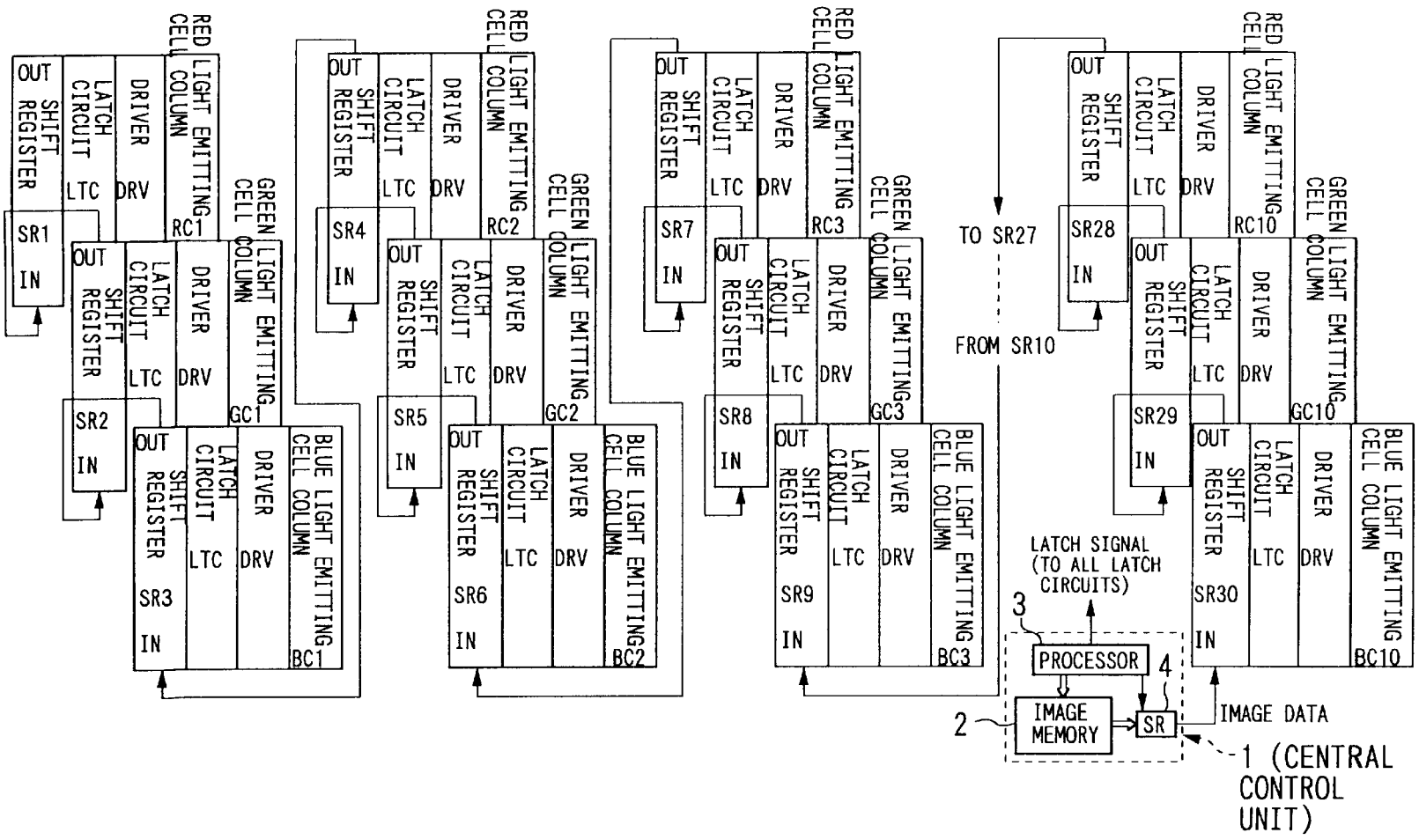
FIG. 5 is a diagrammatic view of a scrolling display apparatus according to the embodiment of the present invention.

A circuit construction of the scrolling display apparatus corresponding to the description of FIGS. 1 to 3 is shown in FIG. 5. As described in detail above, the red light emitting cell column RCi, the green light emitting cell column GCi, and the blue light emitting cell column BCi are composed of sixteen (16) red, green, and blue LED lamps, respectively. For each of the light emitting cell columns, as shown in FIG. 5, a driver DRV for driving the sixteen (16) LED lamps to individually emit light, a latch circuit LTC for providing image data of sixteen (16) bits individually indicating on-off operations of the sixteen (16) LED lamps to the driver DRV, and a 16-bit shift register SR which serves as a transfer path of the image data to be supplied to the latch circuit LTC. Further, as shown in FIG. 1, the ten (10) red light emitting cell columns RCi, ten (10) green light emitting cell columns GCi, and ten (10) blue light emitting cell columns BCi are connected to each other like a belt in the order of (RC1, GC1, BC1), (RC2, GC2, BC2), (RC3, GC3, BC3), . . . , (RC10, GC10, BC10) with large blank sections inserted therebetween to construct the physical screen described above. The thirty (30) shift registers SR provided for the thirty (30) light emitting cell columns in total are numbered with serial numbers in the arrangement order of the light emitting cell columns on the physical screen as shown in FIG. 5. The serial numbers are SR1, SR2, SR3, SR4, . . . , SR29, SR30.

The thirty (30) 16-bit shift registers SR1 to SR30 are all connected in series to construct a shift register of 16×30=480 bits in total. It should be noted that the order in the series connection of the shift registers SR1 to SR30 is reverse to the order of the serial numbers, and an input terminal IN of the 16-bit shift register SR30 serves as an input terminal of the 480-bit shift register.

A central control unit 1 outputs image data serially as hereinafter described in detail and supplies them to the input terminal, i.e., the input terminal IN of the SR30 of the 480-bit shift register described above. When the central control unit 1 outputs data of 480 bits serially, the data are loaded into the thirty (30) 16-bit shift registers SR1 to SR30. As can be seen apparently from the circuit construction of FIG. 5, the first sixteen (16) bits in the data train of the 480 bits outputted from the central control unit 1 are loaded into the shift register SR1 which is located most interior as viewed from the central control unit 1. The second sixteen (16) bits are loaded into the precedent shift register SR2 and the third sixteen (16) bits are loaded into the further precedent shift register SR3. The data are distributed from the central control unit 1 to the thirty (30) 16-bit shift registers SR1 to SR30 in such relationship as just described.

The central control unit 1 outputs a latch signal in a stage after the image data of 480 bits are outputted serially and distributed to the thirty (30) 16-bit shift registers SR1 to SR30, so that the data of sixteen (16) bits loaded in the shift registers SR1 to SR30 are transferred to and thereafter held by the latch circuits LTC provided for the registers and the sixteen (16) LED lamps of each light emitting cell train are driven, i.e., lit or extinguished, by the corresponding drivers DRV in accordance with the latched data of sixteen (16) bits. In this manner, the central control unit 1 executes the operation of outputting image data of 480 bits serially first, and then outputting a latch signal repetitively in a predetermined considerably short cycle to realize scrolling display of an image.

Manner of Storage of Image Data by Image Memory

Image data of the bit map type of a size wherein one column includes sixteen (16) bits and one row has a free length are stored in an image memory 2 of the central control unit 1. Data for sixteen (16) dots in a column are referred to as three-color column data, and the three-color column data are numbered in order like D1, D2, D3, . . . , Dj, . . . . The three-color column data of the jth column of a certain image are denoted by Dj. Further, the three-color column data Dj signifies a set of red data RDj of sixteen (16) bits, green data GDj of sixteen (16) bits, and blue data BDj of sixteen (16) bits.

As shown in FIG. 6, the image memory 2, one word of which is composed of sixteen (16) bits, stores red data RDj at an address (3x), green data GDj at another address (3x+1), and blue data BDj at a further address (3x+2), where x is an integer not less than zero (0, 1, 2, . . . ). Further, the three-color column data RD(j+1), GD(j+1), and BD(j+1) of the (j+1)th column adjacent the three-color column data RDj, GDj, and BDj of the jth column are stored in addresses (3x+3), (3x+4), and (3x+5), respectively.

FIG. 6 explains the followings. The red data RD1 at the top, i.e., at the first column of certain image data in the image memory 2 are stored in an address (f). Similarly, the green data GD1 in the first column are stored in another address (f+1), and the blue data BD1 in the first column are stored in a further address (f+2). The red data RD2, green data GD2, and blue data BD2 in the following second column are stored in addresses (f+3), (f+4), and (f+5), respectively. The red data RD3, green data GD3, and blue data BD3 in the following third column are stored in addresses (f+6), (f+7), and (f+8), respectively. Certain image data are stored in order in an area of the image memory 2 in addresses following the address (f) in such a corresponding relationship as described above.

A processor 3 of the central control unit 1 successively read accesses the image memory 2 in order in accordance with an algorithm which is hereinafter described in detail. The data read out in parallel in sixteen (16) bits from the memory are converted into serial data by a shift register 4 and outputted toward the 480-bit shift register described hereinabove. When the image memory 2 is read accessed thirty times, image data of 480 bits are outputted serially from the central control unit 1 and the data of 480 bits are distributed to the thirty (30) 16-bit shift registers SR1 to SR30. Immediately thereafter, a latch signal is outputted. Scrolling display is performed by repeating the operation cycle at a high speed while data are selected in the following manner.

Manner of Selection at Intervals and Distribution of Image Data

In the example of FIG. 6, it is assumed that image data stored with the top thereof stored at the address (f) of the image memory 2 are to be scrolling displayed on the imaginary screen of FIG. 2. In this instance, the central control unit 1 distributes, in each operation cycle, image data of the image memory 2 to the thirty (30) shift registers SR1 to SR30 in the following manner to control and drive the thirty (30) light emitting cell columns.

It is to be noted that, in the following description, the representation of light emitting cell column at the "yth column position" signifies a light emitting cell column arranged on the yth column from the left on the imaginary screen of FIG. 2. Accordingly, this is naturally different from the set numbers i applied to the ten (10) light emitting cell column sets Si (RCi, GCi, BCi) which construct the physical screen.

Cycle 1

The red data RD1 of the first column at the address (f) are distributed to the shift register SR1 of the red light emitting cell column RC1 at the first column position. The green data GD1 and the blue data BD1 of the first column are not used.

The green data GD2 of the second column at the address (f+4) are distributed to the shift register SR2 of the green light emitting cell column GC1 at the second column position. The red data RD2 and the blue data BD2 of the second column are not used.

The blue data BD3 of the third column at the address (f+8) are distributed to the shift register SR3 of the blue light emitting cell column BC1 at the third column position. The red data RD3 and the green data GD3 of the third column are not used.

The actual light emitting cell columns do not exist at the fourth, the fifth, and the sixth column positions of the imaginary screen of FIG. 2. Therefore, image data for the following three columns are skipped in selection, and data beginning with those of the seventh column are distributed in the following manner.

The red data RD7 of the seventh column at the address (f+18) are distributed to the shift register SR4 of the red light emitting cell column RC2 at the seventh column position. The green data GD7 and the blue data BD7 of the seventh column are not used.

The green data GD8 of the eighth column at the address (f+18+4) are distributed to the shift register SR5 of the green light emitting cell column GC2 at the eighth column position. The red data RD8 and the blue data BD8 of the eighth column are not used.

The blue data BD9 of the ninth column at the address (f+18+8) are distributed to the shift register SR6 of the blue light emitting cell column BC2 at the ninth column position. The red data RD9 and the green data GD9 of the ninth column are not used.

Thereafter, data at the addresses (f+18+18), (f+18+18+4), and (f+18+18+8) are distributed to the shift registers SR7, SR8, and SR9, respectively, in accordance with a similar regularity. Then, after data are distributed to the last shift register SR30, a latch signal is developed as described hereinabove to drive the thirty (30) light emitting cell columns with the data distributed to the thirty (30) shift registers SR1 to SR30.

Cycle 2

Thereafter, the data are distributed so that the image is scrolled leftward by one column. In short, the data of the first column are removed out of the screen, and the data of the second column are adjusted to the first column position of the screen.

The red data RD2 of the second column at the address (f+3) are distributed to the shift register SR1 of the red light emitting cell column RC1 at the first column position. The green data GD2 and the blue data BD2 of the second column are not used.

The green data GD3 of the third column at the address (f+3+4) are distributed to the shift register SR2 of the green light emitting cell column GC1 at the second column position. The red data RD3 and the blue data BD3 of the third column are not used.

The blue data BD4 of the fourth column at the address (f+3+8) are distributed to the shift register SR3 of the blue light emitting cell column BC1 at the third column position. The red data RD4 and the green data GD4 of the fourth column are not used.

The data of the fifth, the sixth, and the seventh columns are skipped because there do not exist actual columns at the corresponding fourth, fifth, and sixth column positions, respectively, on the imaginary screen.

The red data RD8 of the eighth column at the address (f+3+18) are distributed to the shift register SR4 of the red light emitting cell column RC2 at the seventh column position. The green data GD8 and the blue data BD8 of the eighth column are not used.

The green data GD9 of the ninth column at the address (f+3+18+4) are distributed to the shift register SR5 of the green light emitting cell column GC2 at the eighth column position. The red data RD9 and the blue data BD9 of the ninth column are not used.

The blue data BD10 of the tenth column at the address (f+3+18+8) are distributed to the shift register SR6 of the blue light emitting cell column BC2 at the ninth column position. The red data RD10 and the green data GD10 of the tenth column are not used.

Thereafter, data at the addresses (f+3+18+18), (f+3+18+18+4), and (f+3+18+18+8) are distributed to the shift registers SR7, SR8, and SR9, respectively, in accordance with a similar regularity. Then, after the data are distributed to the last shift register SR30, a latch signal is developed as described hereinabove to drive the thirty (30) light emitting cell columns with the data distributed to the thirty (30) shift registers SR1 to SR30.

Cycle 3

Thereafter, data are distributed so that the image is scrolled leftward by another one column. In short, the data of the second column are removed from the screen, and the data of the third column are adjusted to the first column position of the screen.

The red data RD3 of the third column at the address (f+6) are distributed to the shift register SR1 of the red light emitting cell column RC1 at the first column position. The green data GD3 and the blue data BD3 of the third column are not used.

The green data GD4 of the fourth column at the address (f+6+4) are distributed to the shift register SR2 of the green light emitting cell column GC1 at the second column position. The red data RD4 and the blue data BD4 of the fourth column are not used.

The blue data BD5 of the fifth column at the address (f+6+8) are distributed to the shift register SR3 of the blue light emitting cell column BC1 at the third column position. The red data RD5 and the green data GD5 of the fifth column are not used.

The data of the sixth, the seventh, and the eighth columns are skipped because there do not exist actual columns at the corresponding fourth, fifth, and sixth column positions, respectively, on the imaginary screen.

The red data RD9 of the ninth column at the address (f+6+18) are distributed to the shift register SR4 of the red light emitting cell column RC2 at the seventh column position. The green data GD9 and the blue data BD9 of the ninth column are not used.

The green data GD10 of the tenth column at the address (f+6+18+4) are distributed to the shift register SR5 of the green light emitting cell column GC2 at the eighth column position. The red data RD10 and the blue data BD10 of the tenth column are not used.

The blue data BD11 of the eleventh column at the address (f+6+18+8) are distributed to the shift register SR6 of the blue light emitting cell column BC2 at the ninth column position. The red data RD11 and the green data GD11 of the eleventh column are not used.

Thereafter, data at the addresses (f+6+18+18), (f+6+18+18+4), and (f+6+18+18+8) are distributed to the shift registers SR7, SR5, and SR9, respectively, in accordance with a similar regularity. Then, after data are distributed to the last shift register SR30, a latch signal is developed as described hereinabove to drive the thirty (30) light emitting cell columns with the data distributed to the thirty (30) shift registers SR1 to SR30. The operation cycles described above are repeated in a similar manner while scrolling data.

Control Procedure for Data Distribution

Figure 7:
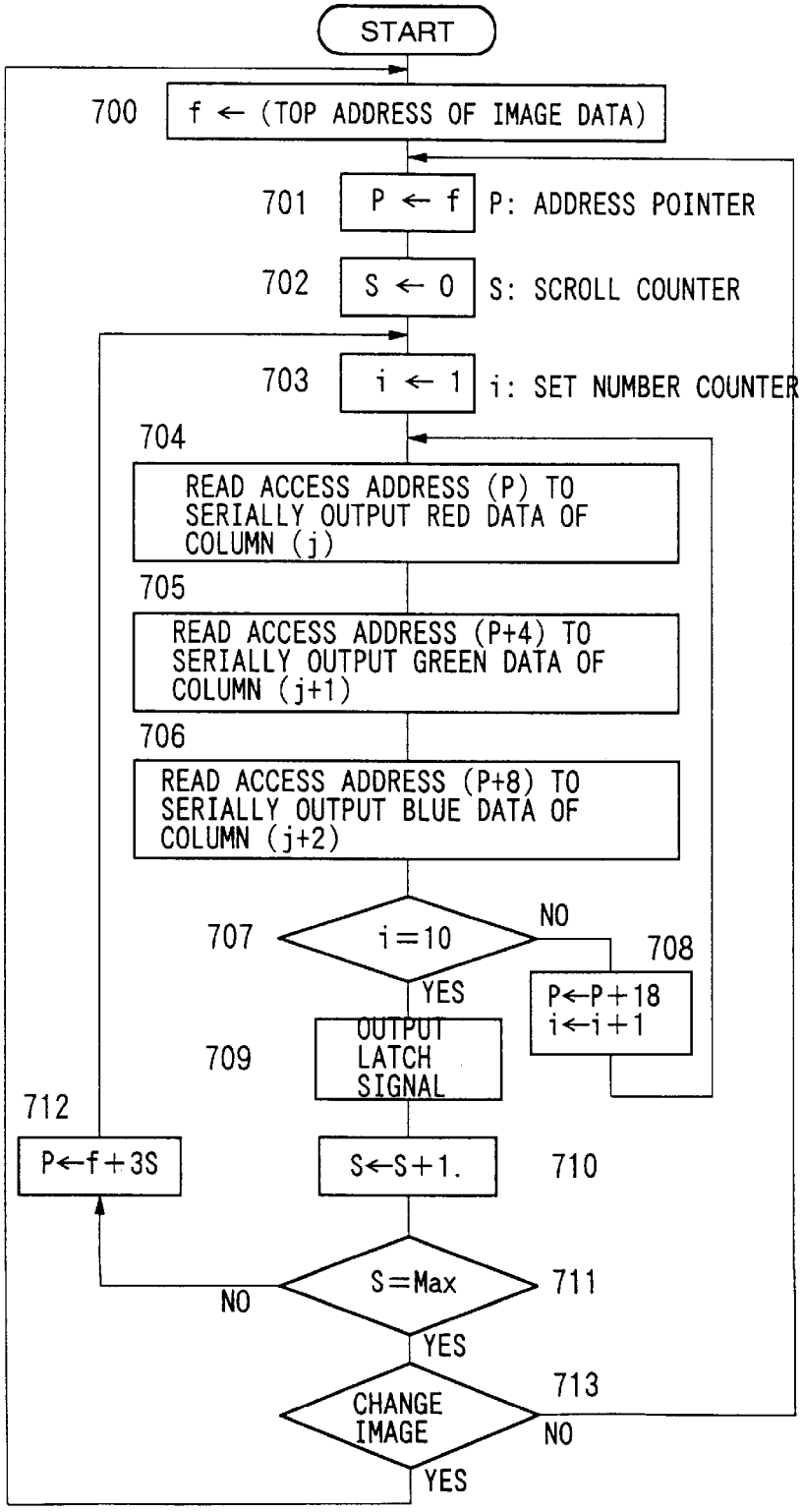
FIG. 7 is a flow chart illustrating an example of an algorithm of data distribution control of the apparatus of the embodiment.

The processor 3 of the central control unit 1 distributes data in the image memory 2 in accordance with the rule described in detail above to effect scrolling display control. An outline of the control procedure is illustrated in a flow chart of FIG. 7.

First, in first step 700, a top address of an image to be displayed is placed into a predetermined register. In next step 701, the top address f is copied into an address pointer p, and then, in step 702, a scroll counter s is set to 0 whereafter a set number counter i is set to 1.

After the foregoing preparations are completed, the address (p) is read accessed to serially output red data of the (j)th column toward the 480-bit shift register. In next step 705, the address (p+4) is read accessed to serially output green data of the (j+1)th column. In next step 706, the address (p+8) is read accessed to serially output blue data of the (j+2)th column. By this, data are distributed to the first light emitting cell column set S1 (RC1, GC1, BC1).

In next step 707, it is checked whether or not the value of the set number counter i is "10" which represents the last value. Since i=1 at this time according to the description, the processing advances to step 708, in which the counter i is incremented by 1 to "2" and eighteen (18) is added to the pointer p to make a new pointer p. Then, in accordance with the new pointer p, steps 704, 705, 706 are successively executed to read out data at the addresses (f+18), (f+22), and (f+26) in a table of FIG. 6 and serially output the data. By this, the data are distributed to the second light emitting cell column set S2 (RC2, GC2, BC2).

When the memory reading processing of steps 704, 705, and 706 is executed ten times while the counter i and the pointer p are updated, data of 480 bits are outputted serially toward the thirty (30) light emitting columns. Since i=10 in this instance, the processing advances to step 709, in which a latch signal is outputted as described above. By this, the LED lamps of the light emitting cell columns are driven to display with the distributed data.

The operations up to this time correspond to the cycle 1 described above, and now, the cycle 2 is entered. First, in step 710, the scroll counter s is incremented by 1, where s=1 according to the description till now. It is confirmed in step 711 that s does not reach a final value Max, whereafter (f+3s) is written into the address pointer p in step 712. According to the description till now, (f+3) makes the initial value of the pointer p and the processing returns to step 703 described above. As a result, image data scrolled by one column are distributed to the light emitting cell columns in the corresponding relationship indicated by cycle 2 of the table of FIG. 6 to drive the light emitting cell columns to display.

As described above, scrolling display control is proceeded along the cycles 1, 2, 3, 4 and so on while incrementing the scroll counter s. When the value of the scroll counter s becomes equal to the final value Max, the processing advances to step 713, in which it is determined whether scrolling display of the same image is to be repeated or switching to scrolling display of another image is performed. In the former case, the processing beginning with step 701 is repeated without changing the top address f. In the latter case, the top address of alternative image data to be displayed is placed into the register f.

Manner in Which Scrolling Display Looks (A) Description under Assumption of Monochrome Display First, it is described how a scrolling display according to the present invention looks without considering a multiple color display but assuming that the display is monochrome display.

As shown in FIG. 1, the thirty (30) light emitting cell columns are arranged at intervals for every three (3) columns in such an order of (RC1, GC1, BC1), (RC2, GC2, BC2), (RC3, GC3, BC3), . . . , (RC10, GC10, BC10) while large blank sections are inserted therebetween and connected to each other like a belt. This is the physical screen. In contrast, as shown in FIG. 2, it is assumed that, on the imaginary screen, three pixel columns, each having sixteen (16) dots are present in a large blank section between a light emitting cell column set Si (RCi, GCi, BCi) and an adjacent light emitting cell column set Sj (RCj, GCj, BCj).

As described above, while the physical screen which includes sixteen (16) dots in one column and thirty (30) dots in one row is regarded as an imaginary screen which includes sixteen (16) dots in one column and fifty seven (57) (=30+3×9) dots in one row in this manner, scrolling display control wherein bit map image data of a 16×57 dot construction are distributed to the thirty (30) light emitting cell columns of the physical screen is performed so that the data may be expanded on the imaginary screen.

Accordingly, when viewed at a certain moment, only one half of an image to be displayed on the imaginary screen, is displayed at intervals on the physical screen. This image has a very large defective part and a character or a picture is displayed in such a degree that it is hardly recognized correctly. However, if the scrolling speed is increased to a certain degree, an after-image effect in recognition in which the blank portions between the partial images at intervals for every three (3) columns are compensated for due to activity of retinae of eyes and a central nervous system of vision of a human. If the physical screen is observed from a location spaced by some degree therefrom, then, although some flickering is felt, the image looks as if an image of a dot density of the imaginary screen which includes sixteen (16) dots in a column and fifty seven (57) dots in a row is scrolling displayed.

If the arrangement pitch of the light emitting cell column sets S1 to S10 increases, in other words, if the number of assumed columns in the blank sections increases, then the viewability is deteriorated by flickering and so forth. However, by increasing the total number of sets to increase the length of the screen and increasing the scrolling display speed, an image being scrolled can be visually recognized as intended, that is, in conformity with the dot density of the image data by an after-image effect even if the number of assumed columns in the blank sections are set to a number more than ten (10). This has been confirmed through many experiments.

(B) Multiple Color Display by Combination of Red, Green, and Blue

Description is given with reference to the table of FIG. 6, which illustrates a manner of distribution of data. For example, the red data RD3, green data GD3, and blue data BD3 of the third column stored in the addresses (f+6), (f+7), and (f+8), respectively, are data corresponding to the same pixel column. Originally, the red LEDs, green LEDs, and blue LEDs included in the same dot column should be driven at a time with the three color data RD3, GD3, and BD3 so that a mixed color of them may be recognized.

As well known in the art, an ordinary multiple color display panel is so devised that a red LED, a green LED, and a blue LED which construct the same pixel are located as near as possible to each other to realize a single multiple color light emitting lamp. Also the pixel construction of a fluorescent screen of a color television is produced in accordance with the same principle.

The visual recognition principle of a multiple color display of the present invention is different from that of the ordinary multiple color display panel. The present invention presupposes scrolling display and realizes a mixed color at a pixel while the positions of the respective color cells and the times of lighting the same are different. This will be described in connection with the example of FIG. 6.

In Cycle 1, although the column data RD3, GD3, and BD3 of the third column are displayed on the blue light emitting cell column BC1 of the third column position, since BC1 is a blue display cell column, on which only the blue data BD3 are displayed. The red data RD3 and the green data GD3 are not used.

In Cycle 2, image data are scrolled by one column and the column data RD3, GD3, and BD3 of the third column are displayed on the green light emitting cell column GC1 at the second column position. However, since GC1 is a green display cell column, on which only the green data GD3 are displayed. The red data RD3 and the blue data BD3 are not used.

In Cycle 3, image data are scrolled by another one column and the column data RD3, GD3, and BD3 of the third column are displayed on the green light emitting cell column GC1 at the second column position. However, since RC1 is a red display cell column, on which only the red data RD3 are displayed. The green data GD3 and the blue data BD3 are not used.

In this manner, of the three color column data RD3, GD3, and BD3 constructing the same pixel column, the blue data BD3 are first displayed by the blue light emitting cell column BC1 of the third column position in Cycle 1, and then the green data GD3 are displayed by the green light emitting cell column GC1 of the adjacent second column position in Cycle 2, whereafter the red data RD3 are displayed by the red light emitting cell column RC1 of the further adjacent first column position in Cycle 3. Display pixel columns of the three colors which has difference both in time and in position of lighting the respective cells in this manner are recognized as a single common pixel column in which the three colors are mixed, to a person who visually observes them as a scrolling display.

This is also a visual observation action by an after-image effect. As well as the action that a character, a picture and so forth are visually observed as intended by an after-image effect by a scrolling display using light emitting cell columns disposed at intervals, if the scrolling speed is increased, then a color mixture effect becomes better, wherein display pixel columns of the three colors which are different both in time and in position of lighting are mixed in color so that they are visually observed as the same pixel column. Also this has been confirmed by many experiments.

Other Embodiments (a) Since the embodiment of one aspect of the present invention which employs LEDs of the three colors of red, green, and blue is described in detail in regard to its principle, construction, operation and effect, an embodiment of another aspect of the present invention which employs light emitting cells of two colors can be inferred readily from the description above. Accordingly, detailed description of the embodiment of the two colors display of the present invention is omitted.

(b) Also light emitting cells other than LEDs can be used.

(c) Where the arrangement pitch of the individual light emitting cell column sets is not necessarily uniform, but may be partially different from the prescribed value. If intermittent selection control of data is performed in accordance with the arrangement distance at the location, an image of a correct aspect ratio over the entire screen can be scrolling displayed without distorting the image displayed.

(d) Each light emitting cell column may be mounted in the form of a single bar-like display unit, and a shift register SR, a latch circuit LTC, and a driver DRV can be built in a bar-like case of it. Further, a light emitting cell column set may be formed from three bar-like display units, and a holder or a connection apparatus such as a stand for combining and coupling the three bar-like display units in parallel at predetermined intervals from each other may be provided.

(e) Image data can be distributed from the central control apparatus to the light emitting cell columns of the individual colors by aparallel transfer method. For example, data are transferred by a bus line for parallel 8 bits. Or, data of red, green, and blue are transferred by a three sets of parallel lines, alternatively. According to a parallel method, a greater amount of data can be transferred within a prescribed time without raising the data transfer speed.

As described in detail above, according to the scrolling display method and apparatus of the present invention, the following significant effects are presented.

(a) A definite image of a large size can be scrolling displayed with a small number of light emitting cells.

(b) A display screen of a large size can be realized not in an apparatus form of a display panel of a rigid body having a size a little larger than a display size but in a flexible apparatus form wherein a large number of light emitting cells are arranged at large intervals.

(c) An image display of multiple colors is realized with a number of light emitting cells as small as possible, and the definition and the color displacement of an image scrolling displayed can be harmonized at very reasonable cost. Comparing with another case wherein each column of light emitting cells has a multiple color displaying function, a driving circuit system can be formed more simply and at a lower cost by adopting the method of the present invention.

What is claimed is:

1. A scrolling display method, comprising the following steps of:

providing a light emitting cell column of a first color wherein m light emitting cells of the first color are arranged linearly with a small distance a left therebetween, a light emitting cell column of a second color wherein m light emitting cells of the second color are arranged linearly with the small distance a left therebetween, and arranging said light emitting cell column of the first color and said light emitting cell column of the second color in parallel to each other with a distance b left therebetween which is substantially equal to the distance a to form a light emitting cell set;

preparing and arranging n sets of said light emitting cell column substantially in parallel to each other in a great pitch greater than substantially three times the distance b such that, by the arrangement, a physical screen wherein the n light emitting cell columns of the first color and the n light emitting cell columns of the second color are connected to each other like a belt and each column includes m dots while each row includes 2n dots;

producing bit map image data with regarding the physical screen as an imaginary screen of a pixel construction wherein one column includes m dots and one row includes w dots, so that a multiple color image may be displayed in the dot density on the imaginary screen, the image data being data of separated colors of image data of the first color and image data of the second color, w being an integer equal to or larger than (3n−1)

arranging the n sets of light emitting cell column which form said physical screen in an average and substantially uniform dispersion in the imaginary screen, where the light emitting cell column of the first color and the light emitting cell column of the second color in one of said light emitting cell column sets correspond to two pixel columns adjacent each other in the imaginary screen;

when it is assumed that bit map image data which includes m dots in one column and includes w dots in on row are expanded on the imaginary screen to display the same, distributing data for n columns selected at intervals from among the image data of the first color for the w columns to said n sets of light emitting cell columns of the first color so that the m light emitting cells of the first color in each of the selected n columns are controlled and driven with the data for m dots of each of the selected columns, and distributing data for n columns selected at intervals from among the image data of the second color for the w columns to said n light emitting cell columns of the second color so that the m light emitting cells of the second color in each of the selected columns are controlled and driven with the data for m dots for each of the selected columns;

in the control wherein data for n columns are selected at intervals from the image data of the first and second colors for the w columns and distributed to the n light emitting cell columns of the first and second colors, respectively, setting the distance between the columns selected at intervals corresponding to the arrangement distance between said light emitting cell column sets arranged dispersedly on the imaginary screen;

in one of said light emitting cell column sets, when the light emitting cell column of the first color is controlled and driven with data of the first color of a certain column selected at intervals, controlling to drive the light emitting cell column of the second color with data of the second color for a column adjacent the selected column; and repeatedly conducting a data processing wherein the light emitting cells of the individual light emitting cell column sets are controlled and driven with the image data selected at intervals while the bit map image data to be expanded on the imaginary screen are successively shifted by one pixel in a direction of a row so that each column of the bit map image scrolls while being alternately displayed by the light emitting cell column of the first color and the light emitting cell column of the second color, so that a scrolling multiple color image having a density if m dots per one column and w dots per one row is visually observed due to an after-image effect of a person who watches the imaginary screen.

2. A scrolling display method, comprising the following steps of:

providing a light emitting cell column of a first color wherein m light emitting cells of the first color are arranged linearly with a small distance a left therebetween, a light emitting cell column of a second color wherein m light emitting cells of the second color are arranged linearly with the small distance a left therebetween, and, besides, a light emitting cell column of a third color wherein m light emitting cells of the third color are arranged linearly with the small distance a left therebetween, and arranging said light emitting cell column of the first color, said light emitting cell column of the second color, and said light emitting cell column of the third color in parallel to each other with a distance b left therebetween which is substantially equal to the distance a to form a light emitting cell set;

preparing and arranging n sets of said light emitting cell column substantially in parallel to each other in a great pitch greater than substantially four times the distance b such that, by the arrangement, a physical screen wherein the n light emitting cell columns of the first color, the n light emitting cell columns of the second color, and the n light emitting cell columns of the third color are connected to each other like a belt and each column includes m dots while each row includes 3n dots;

producing bit map image data with regarding the physical screen as an imaginary screen of a pixel construction wherein one column includes m dots and one row includes w dots, so that a multiple color image may be displayed in the dot density on the imaginary screen, the image data being data of separated colors of image data of the first color, image data of the second color and image data of the third color, w being a integer equal to or larger than (4n−1);

arranging the n light emitting cell column sets which form said physical screen in an average and substantially uniform dispersion in the imaginary screen, so that the light emitting cell column of the first color, the light emitting cell column of the second color, and the light emitting cell column of the third color in one of said light emitting cell column sets correspond to three pixel columns adjacent each other in the imaginary screen;

when it is assumed that bit map image data which includes m dots in one column and includes w dots in one row are expanded on the imaginary screen to display the same, distributing data for n columns selected at intervals from among the image data of the first color for the w columns to said n light emitting cell columns of the first color so that the m light emitting cells of the first color in each of the selected n columns are controlled and driven with the data for m dots of each of the selected columns, distributing data for n columns selected at intervals from among the image data of the second color for the w columns to said n light emitting cell columns of the second color so that the m light emitting cells of the second color in each of the selected columns are controlled and driven with the data for m dots for each of the selected columns, and distributing data for n columns selected at intervals from among the image data of the third color for the w columns to said n light emitting cell columns of the third color so that the m light emitting cells of the third color in each of the selected columns are controlled and driven with the data for m dots for each of the selected columns;

in the control wherein data for n columns are selected at intervals from the image data of the first, second, and third colors for the w columns and distributed to the n light emitting cell columns of the first, second, and third colors, respectively, setting the distance between the columns selected at intervals corresponding to the arrangement distance between said light emitting cell column sets arranged dispersedly on the imaginary screen;

in one of said light emitting cell column sets, when the light emitting cell column of the first color is controlled and driven with data of the first color of a certain column selected at intervals, controlling to drive the light emitting cell column of the second color with data of the second color for a column adjacent the selected column, and controlling to drive the light emitting cell column of the third color with data of the third color for a column further adjacent the selected column; and repeatedly conducting a data processing wherein the light emitting cells of the individual light emitting cell column sets are controlled and driven with the image data selected at intervals while the bit map image data to be expanded on the imaginary screen are successively shifted by one pixel in a direction of a row so that each column of the bit map image scrolls while being sequentially displayed by the light emitting cell column of the third color, the light emitting cell column of the second color, and the light emitting cell column of the first color, so that a scrolling multiple color image having a density of m dots per one column and w dots per one row is visually observed due to an after-image effect of a person who watches the imaginary screen.

3. A scrolling display apparatus which performs scrolling display in accordance with the method according to claim 1 comprising:

the n sets of light emitting cell columns;

a memory in which bit map image data to be displayed are stored;

data processing means for reading out the data from said memory in accordance with an algorithm for selection at intervals and distributing the data to said light emitting cell columns; and driving means for latching the data distributed to said light emitting cell columns by said data processing means to drive the light emitting cells of the columns.

4. A scrolling display apparatus which performs scrolling display in accordance with the method according to claim 2 comprising:

the n sets of light emitting cell columns;

a memory in which bit map image data to be displayed are stored;

data processing means for reading out the data from said memory in accordance with an algorithm for selection at intervals and distributing the data to said light emitting cell columns; and driving means for latching the data distributed to said light emitting cell columns by said data processing means to drive the light emitting cells of the columns.

* * * * *